United States Patent [19]

Weber

[11] Patent Number: 4,531,632

[45] Date of Patent: Jul. 30, 1985

[54] CASE FOR STRINGED INSTRUMENT

[76] Inventor: LeRoy D. Weber, 408 - 200th Ave. East, Sumner, Wash. 98390

[21] Appl. No.: 602,004

[22] Filed: Apr. 19, 1984

[51] Int. Cl.[3] ..... A45C 11/00; B65D 81/00

[52] U.S. Cl. ..... 206/14; 206/314

[58] Field of Search ..... 206/14, 314, 468

[56] References Cited

U.S. PATENT DOCUMENTS

| | | | |
|---|---|---|---|
| 239,617 | 4/1881 | Monroe | 206/14 |
| 344,508 | 6/1886 | Tuttle | 206/14 |
| 361,817 | 4/1887 | Fiorini | 206/14 |
| 1,624,994 | 4/1927 | Stark | 206/14 |
| 1,664,476 | 4/1928 | Geib | 206/314 |
| 1,988,718 | 1/1935 | Cook et al. | 206/314 |
| 2,792,932 | 5/1957 | Freistat | 206/314 |
| 3,326,359 | 6/1967 | Katz | 206/14 |

FOREIGN PATENT DOCUMENTS

| | | | |
|---|---|---|---|
| 714356 | 11/1931 | France | 206/14 |
| 348203 | 5/1931 | United Kingdom | 206/14 |
| 351890 | 7/1931 | United Kingdom | 206/14 |

*Primary Examiner*—William T. Dixson, Jr.
*Assistant Examiner*—Brenda J. Ehrhardt
*Attorney, Agent, or Firm*—Keith D. Gehr

[57] ABSTRACT

The invention comprises an adjustable case for stringed instruments, such as violins, violas, or guitars, which may have different body sizes within any given type. The case has a transverse interior fixed wall, preferably contoured for the button or lower end of the instrument body. This wall can be adjusted longitudinally to form a snug fit for any instrument having a body size within the adjustment range. The moveable wall has a cut-out area to act as a bearing surface for the neck of the instrument and tie-down straps to further eliminate movement during transit. A resilient pad, generally located on the floor of the case, is associated with each end wall structure. These support the sturdier end areas of the back of the body so that the more fragile central portion of the back is held above the bottom panel of the case. Thus, an impact to the outside of the case is not transmitted directly to the instrument.

4 Claims, 7 Drawing Figures

Fig. 4
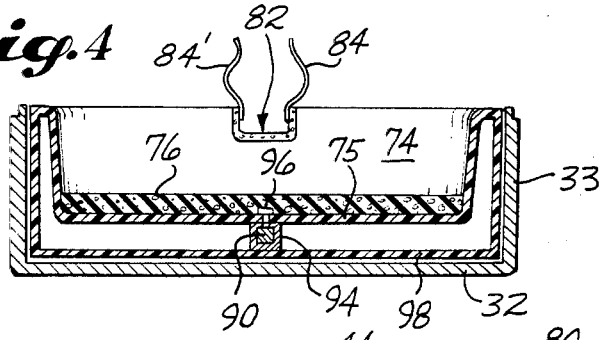
Fig. 5
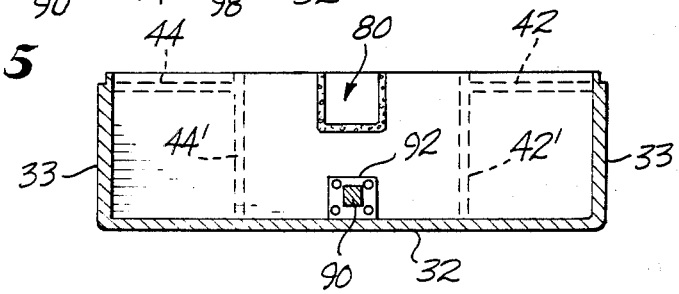
Fig. 6
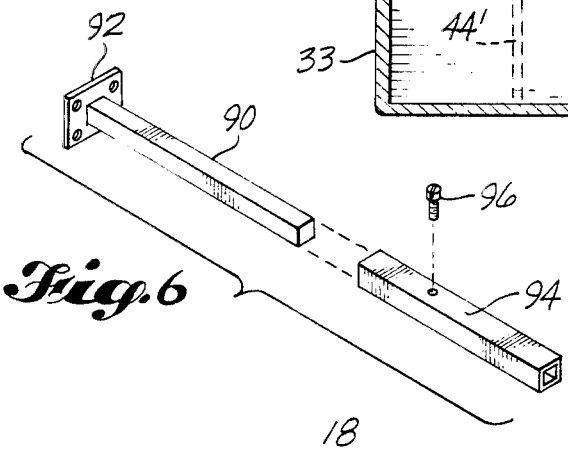
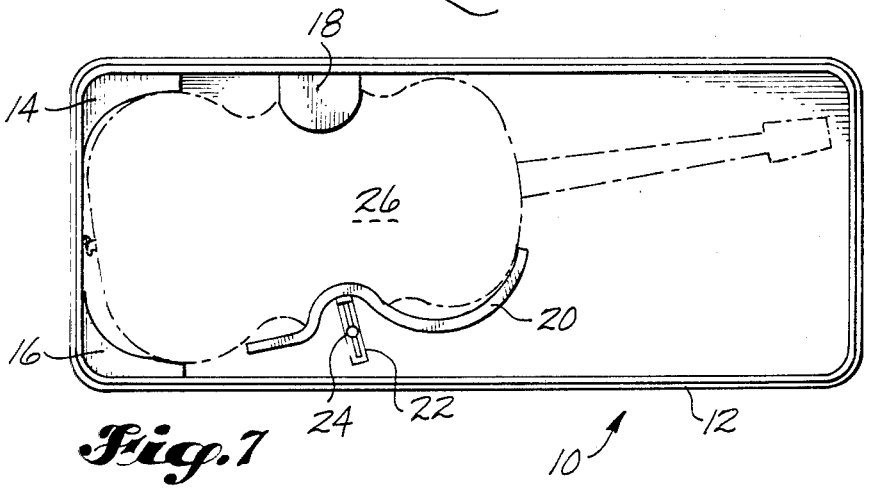
Fig. 7
PRIOR ART

CASE FOR STRINGED INSTRUMENT

BACKGROUND OF THE INVENTION

The present invention concerns a protective case for stringed instruments. It is readily adaptable for use with instruments such as violins or violas which may have different body sizes within a given type.

The cost of concert quality stringed instruments is very high, ranging from thousands well into tens of thousands of dollars. This price range excludes a small group of particularly select instruments which may have much higher values. Needless to say, the artists who own and use these instruments are much concerned about their protection as they are stored and transported between different locations.

If violins and violas can be taken as examples, for many years they were carried in cases which were generally formed in an oversized contour of the instrument itself. Violas, in particular, are manufactured in body sizes which typically range from about 380 to 440 mm long. Obviously, a case designed for an instrument having one of the shorter body sizes cannot accommodate a viola with a longer body length. One would assume that this would not be true of the opposite situation and presume that an instrument with a shorter body could be carried in a case designed for a longer bodied instrument. However, most musicians are reluctant to adopt this expedient. A well designed case will snugly cradle the instrument so that it can have essentially no movement within the case. A snug fit is essential for prevention of damage. For this reason, very few artists are willing to accept the risk of carrying a valuable instrument in an oversized case.

The requirement for instrument cases of different sizes poses problems for both musicians and manufacturers. Manufacturers must make and stock cases in sizes which are only incrementally different. A musician, who may have instruments of several sizes, must likewise individualize the cases to the instruments.

Many musicians are less concerned about protecting their instruments from physical damage when in secure storage or at a home location. Their main concern is protection during transportation and immediately before and after use. This has resulted in a demand from musicians having several instruments for a solid case which is adjustable to instruments having different body sizes. To the present inventor's knowledge, no adjustable cases of the type in which the case is generally contoured to resemble the instrument have ever been available. In recent years many of the better quality instrument cases have been rectangular in outline. These contain internal blocking and padding designed to hold the instrument snugly in place. The rectangular case has an additional advantage in that it offers more storage space for bows and accessories such as spare strings and rosin. One adjustable rectangular case has been made available by a German supplier. This has a movable fence which engages one side of the instrument body while the other side of the body is maintained against a fixed surface. The protection offered to the instrument by a case of this type is not particularly good and it has not found wide acceptance among musicians.

The present invention has proved to be an excellent solution to the problem of providing a case which is adjustable for instruments having different body lengths and will offer secure protecting against damage during storage and transportation.

SUMMARY OF THE INVENTION

The present invention is an adjustable protective case for a stringed instrument. It is particularly well adapted for instruments such as violins, violas, guitars, etc. which have a wooden body portion to which is attached a neck and finger board. It comprises as a first element a hard-sided rectangular outer carrying case which is conventionally manufactured in the manner of fine luggage. Within the outer case is a fixed transverse bearing wall which is generally contoured to conform to one end of the instrument body. Displaced within the outer case from this fixed wall is a movable transverse bearing wall. The side of this movable wall facing the fixed wall is contoured to generally conform to the other end of the instrument body. One of these walls has a cut-out section, centered along the longitudinal axis of the case, which is adapted to cradle and serve as a bearing surface for the instrument neck. The movable wall is adapted for limited longitudinal adjustment in order that it can snugly hold instruments having bodies of different lengths. In its preferred form, the fixed wall is located at or adjacent to one end of the carrying case. This wall may be made integral with one end of the outer case. The transverse movable wall is located generally within the central area of the case. This will contain the cut-out section to receive the neck of the instrument. It will be understood by those skilled in the art that the wall generally located within the central area of the case could be the fixed wall and the transverse wall adjacent to the end of the case could be the movable wall. However, construction is somewhat simpler when the case is made according to the preferred mode.

It is desirable that the case further includes a transverse fixed partition adjacent to the side of the transverse movable wall which will be located away from the instrument body. For ease of description, the side of the transverse movable bearing wall which will be adjacent to the instrument body will be denoted the first side of this wall. The opposite side, that which is not in contact with the instrument body, will be identified as the second side. In one preferred embodiment, this transverse partition supports a longitudinal guide means, normally in the form of a cantilevered rod, which is operatively associated with a corresponding guideway in the movable wall. The movable wall is slideable along the guide rod in order to adjust the case for instrument body length. A set screw, or other type of locking device, enables the movable wall to be fixed in position until it is again desired to adjust the case for an instrument of different size.

The transverse fixed partition will also have a cut-out portion located along the longitudinal axis of the case. This cut-out is usually padded and adapted to cradle the neck of the instrument in cooperation with the corresponding cut out in the movable wall. Either the fixed transverse partition or the movable wall will usually have a strap or other means to securely tie down the neck of the instrument while it is in the case.

In its most preferred form, the case will also have relatively thin transverse resilient pads located adjacent to and essentially at right angles to the bearing surface of each of the bearing walls. These resilient pads are adjacent to the bottom of the carrying case. Here they act as bearing surfaces to support the back of the instrument body at each end so that the rest of the back surface is out of contact with the bottom of the case. This support is important because, without it, an impact to the outside of the case can be transmitted directly to the fragile back portion of the instrument body. It is most convenient if the pad adjacent to the movable wall is made as a part of and movable with the wall.

It is an object of the present invention to provide a case for a stringed instrument which is adjustable for instruments having different body sizes.

It is a further object to provide an adjustable case for a stringed instrument which is simple to construct and which offers secure protection to the instrument.

It is another object to provide an adjustable case for a stringed instrument that eliminates the need for manufacturing and stocking several individually sized cases.

These and many other objects will become readily apparent to those skilled in the art upon reading the following detailed description taken in conjunction with the drawings.

BRIEF DESCRIPTION OF THE DRAWINGS

FIG. 4 is a transverse cross section taken along line 4—4 of FIG. 2.

FIG. 5 is a transverse cross section taken along line 5—5 of FIG. 2.

FIG. 6 is a detail in perspective of one form of adjustment means.

FIG. 7 is a top plan view of a prior art adjustable case.

DESCRIPTION OF THE PREFERRED EMBODIMENTS

Figure 1:
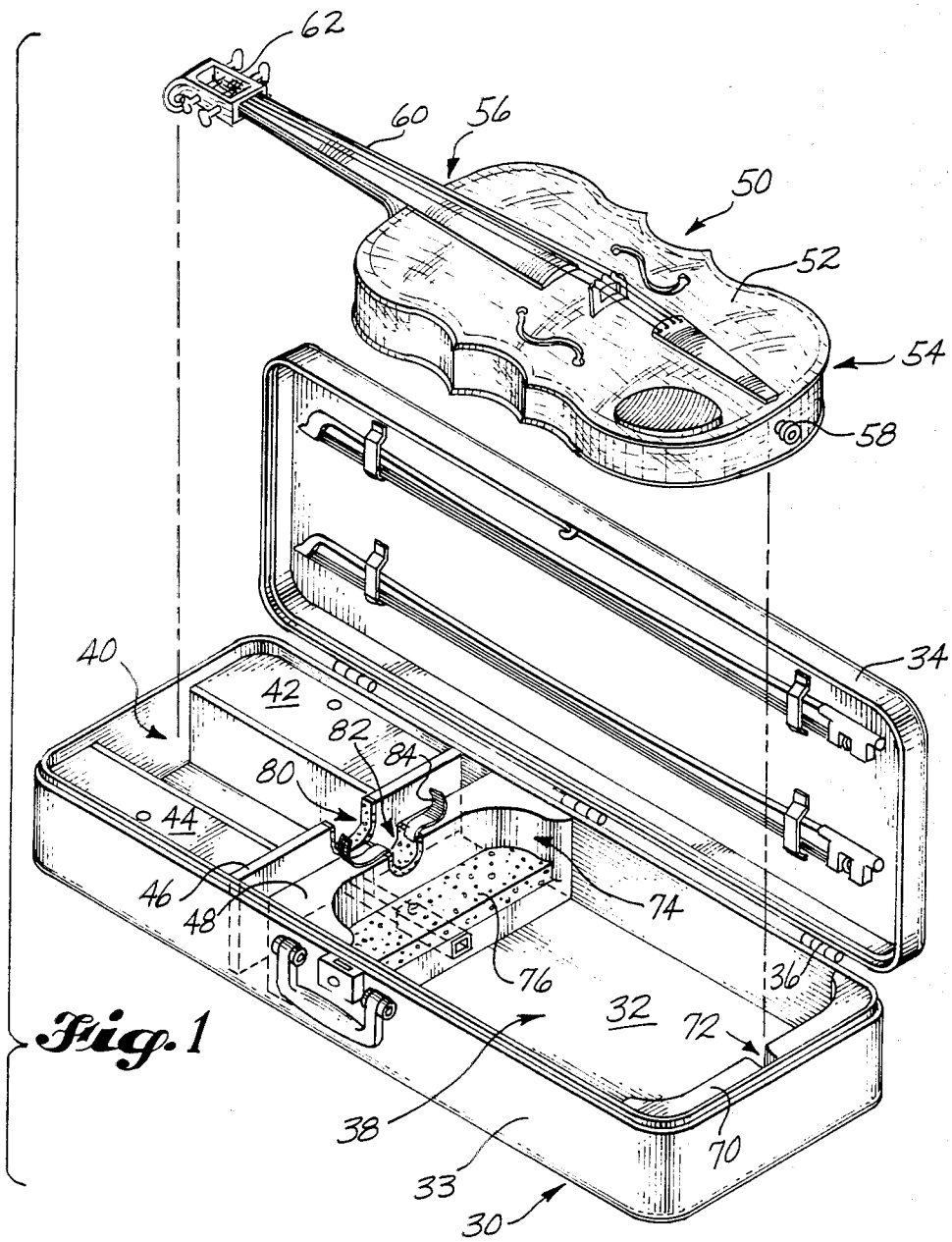
FIG. 1 is a perspective view of the adjustable instrument case taken from a high front position.

Construction of the present instrument case can be readily visualized by reference to the drawings. FIG. 7 is considered first since it shows the only adjustable case in the prior art of which the present inventor is aware. The case is generally shown at 10 and consists of a rectangular luggage-type hard outer case 12. This contains fixed end cushions or corner blocks 14–16 which are generally contoured to receive the button end of a violin or viola body. A waist block 18 is located to fit within the waist area of one side of the instrument body. The other side of the body is engaged by a movable fence 20 which is adjustable on a slide bar 22, retained by a set screw 24. The back of the instrument 26, shown here in phantom form, rests against the bottom of the case. The instrument itself is located somewhat diagonally across the case. No support is provided for the neck of the instrument. This case is generally considered to be unsatisfactory because it is based on a number of compromises, all of which work together to provide less than snug cradling against movement of the instrument. The actual bearing surface provided for the instrument side walls is relatively low since the location and contour of the corner blocks 14–16 and waist block 18 must be adaptable for a full range of instrument sizes.

Figure 2:
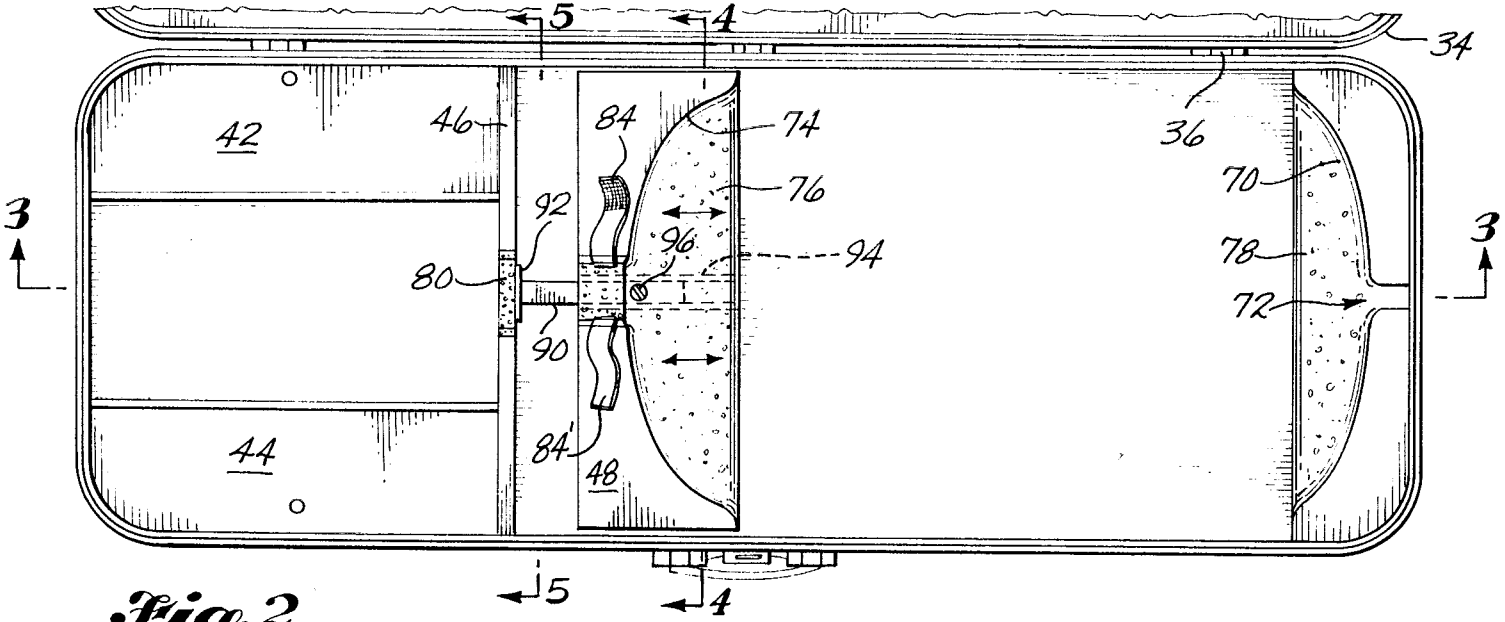
FIG. 2 is a top plan view of the instrument case.
Figure 3:
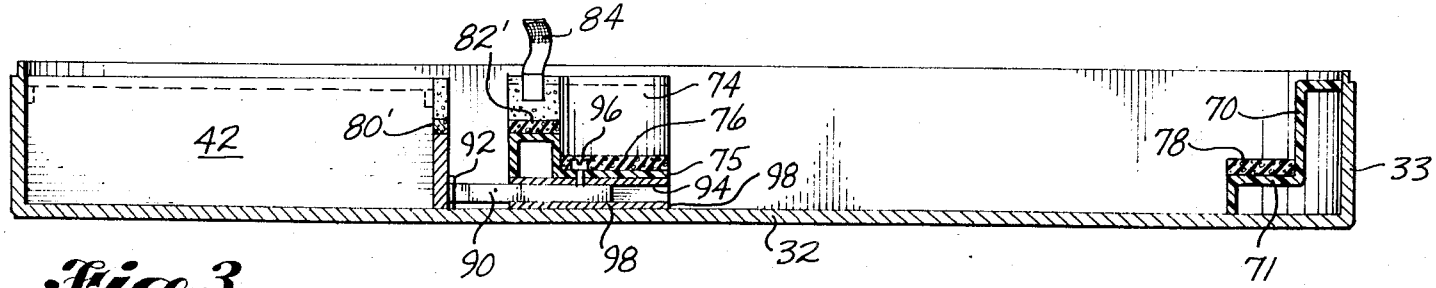
FIG. 3 is a longitudinal cross section along line 3—3 of FIG. 2.

Referring now to FIGS. 1 and 2, a rectangular luggage-style outer case is generally shown at 30. This comprises a hard bottom panel 32, rigid side walls 33, and a lid or cover 34. The cover is attached to the lower part of the case by hinges 36, only one of which is numbered. The right hand end of the case contains a space 38, to retain the body of the instrument, and an adjoining space 40 to hold the neck and peg box of the instrument. Storage compartments are provided on either side of the neck. These compartments have hinged tops 42, 44 and side walls 42', 44'. One end of the storage compartments is formed by the case wall itself. The other end is formed by a fixed partition 46. Adjacent to the fixed partition is a movable transverse wall assembly 48. The second side of this movable wall, adjacent to the fixed partition, is planar while the first side is generally contoured to receive the neck end of the instrument body.

The instrument itself, shown projected out of the case, consists of a body portion 52 having a lower or button end 54, and an upper or neck end 56. The string assembly is anchored at the lower end by a button 58. Neck 60 is attached to the body at one end and terminates at its other end in a scroll and peg box 62.

When instrument 50 is placed into the case, the lower end will fit snugly against the contoured, padded fixed transverse wall 70. The fixed wall contains a recessed area 72 adapted to receive the button at the lower end of the body. The term "fixed wall" should be considered in its broadest sense to means either a unitary structure or, as shown here, it can be a pair of side-by-side contoured pieces made unitary by being assembled to one end of the case.

The construction of the movable wall 48 is best seen in FIGS. 2–5. The portion which contacts the edges of the instrument body comprises a contoured padded surface 74. There is a shelf area 75 which is unitary with the wall. The shelf serves as a support for the back of the instrument as will be explained more fully later. Movable wall 48 may be most conveniently made in two pieces. The upper piece is formed from an appropriately contoured plastic molding. This may be made by any conventional molding process such as vacuum forming. A planar lower portion 98 is ultimately cemented to the upper part to complete the molding. This is then finished by applying appropriate padding and a surface covering. The shelf area 75 of the movable wall contains a resilient pad 76 which acts as a bearing surface for the neck end of the instrument back. A corresponding pad 78 is adjacent to the fixed wall to receive the button end of the instrument back. The upper surface of pad 76 is preferably somewhat higher above the bottom of the case than the surface of pad 78 so that the neck and the scroll of the instrument are suspended well out of contact with the bottom of the case. Fixed partition 46 contains a cut-out portion 80 located along the longitudinal axis of the case. This is covered with cushioning material 80' and acts as a bearing surface for the neck of the instrument. Movable wall 48 has a corresponding cut-out 82 covered with cushioning 82' to provide a second bearing point for the instrument neck. Tie-down straps 84, 84' serve to hold the neck of an instrument tightly in place within the case. These may be of any conventional construction. A preferred type of strap is equipped with hook and loop closure tape.

Adjustment of movable wall 48 is accomplished through the use of an adjustment rod 90 which has a flanged base 92 attached by screws to transverse partition 46. The adjustment rod slides in a tube or guideway 94 which is cemented or otherwise firmly attached to the base 98 of the movable wall. The adjustable wall can be conveniently held in place by the use of a set screw 96 which is covered by pad 76 during use. The movable wall rests on the base of case 32 and is sized so that it fits snugly but not tightly between the longitudinal side walls 33 of the case. It will be readily evident that the adjustment mechanism just described could be constructed in a number of different ways that would be the full mechanical equivalent of the one shown. As one example, rod 90 could be anchored to the bottom of the outer case rather than being cantilevered from wall 46.

Having thus described the best mode known to the inventor of making the adjustable instrument case, it will be apparent that many variations could be made without departing from the spirit of the invention. The invention is to be considered as limited only by the following claims.

What is claimed is:

1. A protective case for a stringed instrument having a body and a neck with a fingerboard which comprises:

a. a generally rectangular outer carrying case;

b. a fixed contoured bearing wall located adjacent to one end of the carrying case, the wall adapted to generally conform to one end of an instrument body;

c. an adjustably moveable transverse bearing wall located within the central area of the case, said transverse wall having a cut-out section generally centered along the longitudinal axis of the case and adapted to receive and serve as a cradle for the instrument neck;

d. resilient transverse pad means located adjacent to and essentially at right angles to each bearing wall and adjacent to the bottom of the carrying case in order to act as bearing surfaces to support the back of the instrument body at each end so that the back of the body is out of contact with the bottom of the case, the pad means adjacent to the moveable wall being moveable with said wall, said moveable bearing wall being adapted for limited longitudinal adjustment in order to snugly hold instrument bodies of different lengths.

2. The case of claim 1 which further includes a transverse fixed partition adjacent to the second side of the transverse moveable wall, said partition supporting a longitudinal guide means operatively associated with a guideway in the moveable wall, the moveable wall being slideable along the guide means in order to adjust the case for instrument body length.

3. The case of claim 2 in which the transverse fixed partition has a cut-out portion located along the longitudinal axis of the case, said cut-out adapted to cradle the neck of the instrument in cooperation with the cut-out in the moveable wall.

4. The case of claim 1 in which the movable wall further has securing means adjacent to the cut-out to restrain the neck of an instrument.

* * * * *